US011297954B2

(12) United States Patent
DeFranks et al.

(10) Patent No.: US 11,297,954 B2
(45) Date of Patent: Apr. 12, 2022

(54) MATTRESS PANELS INCLUDING FLAME RETARDANT FIBERS

(71) Applicant: DREAMWELL, LTD., Atlanta, GA (US)

(72) Inventors: Michael S. DeFranks, Atlanta, GA (US); Sheri L. McGuire, Duluth, GA (US)

(73) Assignee: DREAMWELL, LTD., Doraville, GA (US)

( * ) Notice: Subject to any disclaimer, the term of this patent is extended or adjusted under 35 U.S.C. 154(b) by 214 days.

(21) Appl. No.: 15/904,817

(22) Filed: Feb. 26, 2018

(65) Prior Publication Data

US 2018/0249843 A1 Sep. 6, 2018

Related U.S. Application Data

(60) Provisional application No. 62/465,446, filed on Mar. 1, 2017.

(51) Int. Cl.

| | |
|---|---|
| ***A47C 31/00*** | (2006.01) |
| ***A47C 27/12*** | (2006.01) |
| ***B68G 3/00*** | (2006.01) |

(52) U.S. Cl.

CPC ..... *A47C 31/001* (2013.01); *A47C 27/121* (2013.01); *A47C 27/122* (2013.01); *B68G 3/00* (2013.01)

(58) Field of Classification Search

CPC ... A47C 31/001; A47C 27/122; A47C 27/121; B68G 3/00

See application file for complete search history.

(56) References Cited

U.S. PATENT DOCUMENTS

| | | | | |
|---|---|---|---|---|
| 4,069,363 | A * | 1/1978 | Segraves | D01F 8/12 428/359 |
| 5,702,801 | A * | 12/1997 | Chien | D04H 1/74 156/181 |
| 7,074,499 | B2 * | 7/2006 | Schnurer | D01F 1/106 428/297.4 |
| 7,736,696 | B2 | 6/2010 | Piana et al. | |
| 2004/0158928 | A1 * | 8/2004 | Gladney | A47C 31/001 5/698 |
| 2006/0000024 | A1 * | 1/2006 | McGuire | D04H 1/43828 5/698 |
| 2007/0283493 | A1 * | 12/2007 | Link | A47C 31/001 5/483 |
| 2007/0298668 | A1 * | 12/2007 | DeFranks | A47C 31/001 442/59 |

(Continued)

OTHER PUBLICATIONS

Textile World. Jul. 19, 2010, "Specialty Markets—Bicomponent Fibers," <https://www.textileworld.com/textile-world/nonwovens-technical-textiles/2010/07/specialty-markets-bicomponent-fibers/> (Year: 2010).*

*Primary Examiner* — Robert G Santos
*Assistant Examiner* — Alison N Labarge
(74) *Attorney, Agent, or Firm* — Cantor Colburn LLP

(57) ABSTRACT

Mattress assemblies including fiber panels generally include bicomponent fibers including optically active particles within a core thereof. The bicomponent fibers can be treated with a fire retardant or untreated and blended with fire retardant fibers. The bicomponent fibers are configured to transform radiant body heat of an end user.

3 Claims, 2 Drawing Sheets

(56) References Cited

U.S. PATENT DOCUMENTS

| | | | | |
|---|---|---|---|---|
| 2013/0045382 | A1* | 2/2013 | Horinek | G21F 1/00 428/366 |
| 2015/0096125 | A1* | 4/2015 | DeFranks | A47C 31/001 5/698 |
| 2015/0147518 | A1* | 5/2015 | DeFranks | B32B 5/08 428/96 |
| 2016/0235215 | A1* | 8/2016 | Lowe | A47C 21/044 |

* cited by examiner

MATTRESS PANELS INCLUDING FLAME RETARDANT FIBERS

CROSS-REFERENCE TO RELATED APPLICATIONS

This application is a NON-PROVISIONAL and claims the benefit of U.S. Application Ser. No. 62/465,446, filed Mar. 1, 2017, which is incorporated herein by reference in its entirety.

BACKGROUND

The present disclosure generally relates to mattress panels including flame retardant treated fibers.

Mattress and mattress sets sold in the United States are required to meet an open flame requirement as codified in 16 C.F.R. Part 1633 (2007). While materials used to meet these requirements vary from product to product, the overall approach has generally been to encase the mattress with a flame resistant barrier material underlying the outermost mattress layer e.g., fabric layer, ticking layer, and the like. The materials used by most mattress manufacturers are non-woven high loft or needle punched fiber batting; although, knitted sock-style barrier materials are also used albeit to a lesser extent. In some instances, the fibers are treated with a flame retardant.

While current flame retardant battings may meet the standards set forth in 16 C.F.R. Part 1633, many of these commercial offerings offer little in the way of user comfort. Moreover, commercially available fire resistant battings are generally insulative and do little with regard to temperature management and moisture control.

BRIEF SUMMARY

Disclosed herein are mattress assemblies including fire retardant fiber mattress panels, e.g., a fiber batting layer. In one or more embodiments, the mattress assembly includes a fiber batting layer having a top planar surface and a bottom planar surface, the fiber batting layer including a plurality of flame retardant fibers disposed between the top surface to the bottom surface, wherein the fibers comprise optically active particulate materials supported thereon.

The disclosure may be understood more readily by reference to the following detailed description and drawings of the various features of the disclosure and the examples included therein.

BRIEF DESCRIPTION OF THE DRAWINGS

The specifics of the exclusive rights described herein are particularly pointed out and distinctly claimed in the claims at the conclusion of the specification. The foregoing and other features and advantages of the embodiments of the invention are apparent from the following detailed description taken in conjunction with the accompanying drawings in which:

DETAILED DESCRIPTION

Figure 1:
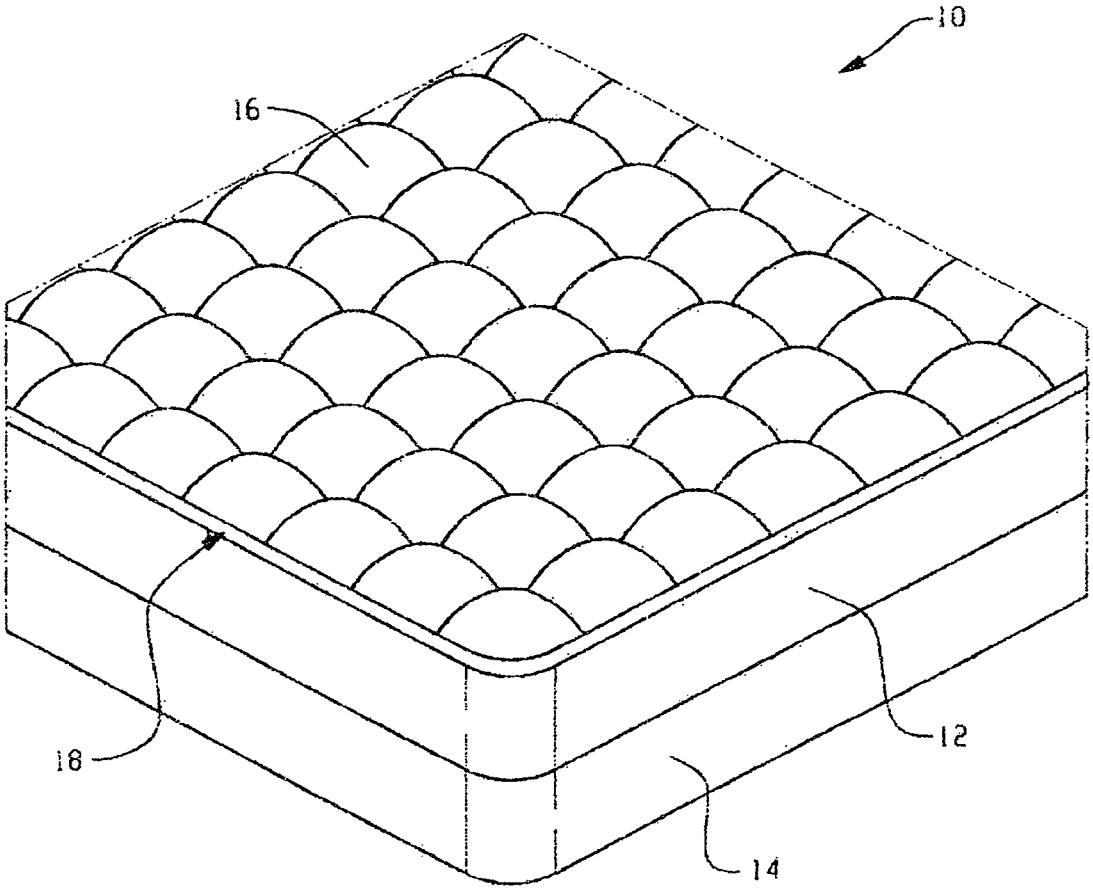
FIG. 1 illustrates a partial perspective view of a mattress and a foundation including a fire retardant batting layer in accordance with the present invention.

Disclosed herein are fire retardant fibers for use in cushioning articles such as mattress batting layers. At least a portion of the fibers can be a synthetic polymer bicomponent fiber including a first component (a sheath) and a second component (a core)—one or both of which can include optically active particles therein. In one or more embodiments, the bicomponent fibers can be made from a polyester such as polyethylene terephthalate and the optically active particles can be embedded into the core of the fiber. The optically active materials are natural minerals as will be described in greater detail below. The bicomponent fibers with the optically active particles are treated with a fire retardant and at least a portion of these fire retardant treated bicomponent fibers are used in cushioning articles in accordance with the present invention. Alternatively, fire retardant treated polymer fibers such as lyocell are blended with untreated bicomponent fibers including the optically active materials. That is, the bicomponent fibers including the optically active materials are not fire retardant treated and are blended with fire retardant treated fibers and/or with fibers that are inherently fire retardant. It should be apparent that the amount of fire retardant treated fibers and/or inherently fire retardant fibers are in an amount effective to meet the standards codified in 16 C.F.R. Part 1633 (2007).

The bicomponent fibers, whether fire retardant treated or not, work with light and an end users' body in a unique way for cushioning applications. With these fibers, light that is emitted by the body passes through the optically active material and is absorbed. The light is then re-emitted back to the end users' body in a manner that allows the body to work more efficiently providing improved temperature management. Additionally, by treating at least a portion of the bicomponent fibers with a fire retardant or with blends including the biocomponent fibers and fibers that are fire retardant, cushioning panels made from these fibers can be configured to meet the standards set forth in 16 C.F.R. Part 1633.

Exemplary bicomponent fibers including optically active particles are commercially available under the trade name Celliant® from Hologenix, LLC, of Newport Beach, Calif. Additional information about Celliant® fiber is provided in U.S. Pat. No. 7,074,499 and US Pub. No. 2013/0045382, which are herein incorporated by reference in their entireties.

The bicomponent fibers can contain, for example, a polyester fiber that is infused with one or more natural minerals as the optically active material. The optically active materials are in the form of a powder that contains one or more of aluminum oxide ($Al_2O_3$), quartz ($SiO_2$), and titanium dioxide ($TiO_2$) in rutile form. By way of non-limiting example, the powder can have a dry weight ratio of active material of titanium dioxide, quartz, and aluminum oxide of 10:10:2. The fibers further includes a resin, such as a polymer. Examples of polymers include polyesters, such as polyethylene terephthalate (PET). The powder form of the optically active materials can be dispersed into the resin, and may constitute about 0.5 percent to about 20 percent of the resin/powder mixture, or between 1 percent to 10 percent of the resin/powder mixture. In one or more embodiments, the powder constitutes from about 1 to about 2 percent of the total weight of the mixture. In one or more embodiments, one half ton of fiber can be produced using 100 pounds of the powder combined with about 1.000 pounds of PET.

In one or more embodiments, the powder form of the active materials is introduced into the polymeric resin by compounding. For example, 100 pounds of optically active powder can be compounded with about 250 to 300 pounds of PET.

In one or more embodiments, the powder may comprise aluminum oxide ($Al_2O_3$), quartz ($SiO_2$), and/or titanium dioxide ($TiO_2$—in rutile form). Titanium dioxide may be obtained from any commercially available source, such as from Millennium Chemicals, Inc., Hunt Valley, Md. Quartz may be obtained from any commercially available source, such as Barbera Co., Alameda, Calif. Aluminum oxide may be obtained from any commercially available source, such as from Industrial Supply, Loveland, Colo.

Aluminum oxide has a unique property that promotes infrared light bandshifts under certain conditions. When aluminum oxide is combined with other materials, such as those described herein, interaction with infrared (IR) light occurs. For example, the IR light emission of the human body is absorbed and excites electron energy levels in the atoms and molecules of the components of the compositions of the present invention. As the electrons return to their previous energy levels they release energy in the IR range but at a different wavelength, i.e., a longer wavelength. The compositions of the present application, when used in a cushioning article or covering, such as a sheet or a batting material, utilize these bandshifting properties of aluminum oxide to reflect longer infrared wavelengths back into the human body. The longer infrared wavelength, for example, allows capillaries to relax and be less constricted, resulting in improved body circulation.

Quartz, or silicon dioxide, is biologically benign if it is incorporated into a carrier material in solid bulk form. Quartz is also capable of non-linear frequency multiplication, and, in proper combination with a particular wavelength and a carrier, may emit ultraviolet (UV) light. UV light is known to inhibit bacterial growth and the creation of ozone. UV that has a wavelength that is too short can be detrimental to the human system. Quartz may be used to absorb the shorter wavelength UV light if its physical particle size is close to the wavelength of light that should be excluded. In the present invention, quartz may be used to increase frequency or shorten wavelength.

Titanium dioxide is unique because it has a high refractive index and also has a high degree of transparency in the visible region of the spectrum. Titanium dioxide is often used as a sunblock in sunscreens because it reflects, absorbs, and scatters light and does not irritate the skin.

Particle size and shape of the active materials in the powder may also affect the end product by controlling the wavelength of light that is allowed to pass through the particles. In a specific embodiment, a particle size of about 1.4 microns or smaller is used for aluminum oxide. The particle shape may be scalloped. The particle size of quartz may be about 1.5 microns or smaller. The quartz particles may be spherical or substantially spherical. The titanium dioxide particles may be about 2 microns or smaller and triangular with rounded edges.

In the present invention, at least a portion of the fibers in the particular cushioning article are the bicomponent fibers with the optically active particles, which in some embodiments are fire retardant treated. By way of example, fire retardant fiber panels can be employed in mattresses as a fire resistant batting material. FIG. 1 shows a perspective view of a bedding construction 10 that includes a mattress 12 and an optional support 14, such as a box spring or foundation, which can be supported on a frame (not shown). The foundation 14 may be conventional, adjustable and optionally may be absent for the bed. The mattress 12 may have, for example, a foam core, a spring core, a pocketed coil core, a viscoelastic core or a core that combines foam and coils of the type known in the art to provide a support structure for the sleeping user.

At least one major surface 16 of mattress 12 includes a fire retardant batting layer 18. However, the mattress 12 may be a two-sided mattress, in which case both major surfaces may be sleeping surfaces and may including a fire retardant batting layer 18. The batting layer is generally defined as a padding layer and is typically at or near one or both of the major surfaces. The depicted fire retardant batting layer 18 substantially overlies the core of the mattress 12, thereby overlying the interior inner spring and/or foam core.

Figure 2:
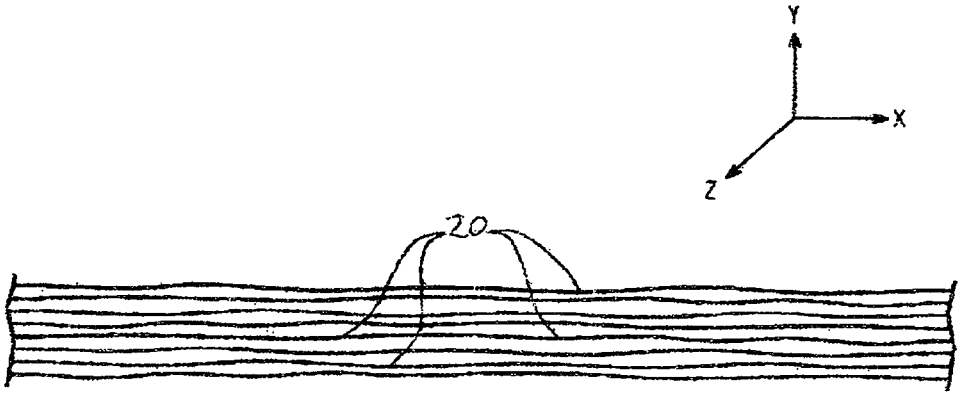
FIG. 2 illustrates a cross-sectional view of a non-woven batting material with carded and horizontally cross-lapped fibers in accordance with the present disclosure.
Figure 3:
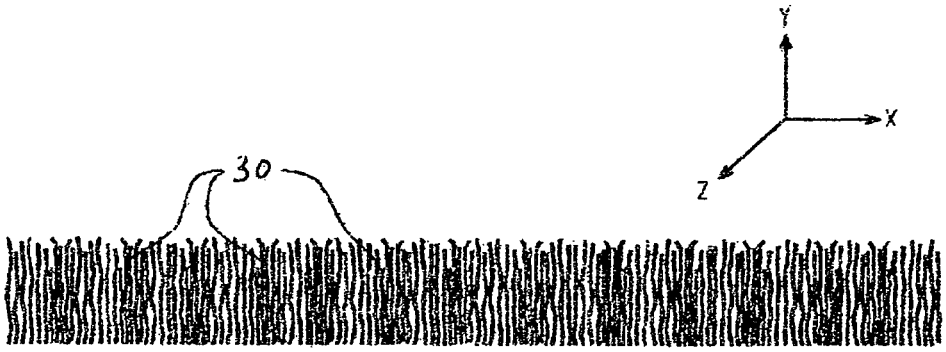
FIG. 3 illustrates a cross-sectional view of a non-woven batting material with vertical oriented fibers in accordance with the present disclosure.

In the fire resistant batting layers, the fibers can be or carded and cross lapped as shown in FIG. 2 or substantially vertically oriented as shown in FIG. 3. In FIG. 2, the resulting, cross-sectional structure of the carded and cross lapped fibers can generally be defined as primarily composed of horizontally oriented liber webs 20. In contrast, as shown in the cross-sectional view in FIG. 3, the vertically oriented fibers 30 are arranged substantially perpendicular to ground. In one or more embodiments, a fire retardant is applied to the bicomponent fibers with the optically active particles or other fibers in embodiments where the biocomponent fibers are untreated, wherein the fibers by themselves may have varying degrees of flame retardancy depending on the polymer composition and the optically active particles. This would provide consumer benefit of meeting the regulatory flame retardancy benefit requirements.

The flame retardant may be added to the bicomponent fibers with the optically active particles using application methods known to those skilled in the art. The flame retardant may be singular, or in combination with other finishing chemistries like anti-stats, lubricants, binders, antimicrobials, color, water and oil repellents, surfactants, and other chemical auxiliaries known to the art. Following the application of the chemistry, which may be done using water or other solvents as a vehicle for uniformly distributing the treatment, the fibers can be centrifuged and dried. Exemplary application processes are disclosed in U.S. Pat. No. 7,736,696 to Tintoria-Piana, incorporated herein by reference in its entirety.

By way of example, a closed-loop system and process can be used for applying the fire retardant chemicals to the fibers. The untreated bicomponent fibers with the optically active particles are first positioned in a vessel such as a dye machine, which circulates the fire retardant chemicals. The fire retardant chemicals may be in the form of a solution, a dispersion or emulsion. In some embodiments, the fire retardant chemicals are in the form of an aqueous solution. The fire retardant chemical solution, dispersions, emulsion or otherwise may be at room temperature or at an elevated temperature. In most embodiments, the fire retardant chemical solution, dispersions, emulsion or otherwise will be at a temperature from about 4° C. to about 100° C.; in one or more other embodiments, from about 20 to about 50° C. and in still one or more other embodiments, at about ambient temperature.

After absorption of the fire retardant chemical on the sheath and/or into the core of the bicomponent fibers with the optically active particles and any other types of fibers if the bicomponent fibers are used in a blended formulation, non-absorbed fire retardant chemicals are recovered and re-used on subsequent batches of fibers. In some embodiments, the re-use of fire retardant chemicals can take place in the same vessel that is used to treat successive batches of fiber. Alternatively, recovery can be achieved by directing the non-absorbed fire retardant composition into a second dye machine containing additional fibers, or by extracting the fire retardant composition by centrifugation or other means, or by a combination of the two processes. The treated fibers may then be rinsed and dried. Alternatively, the fire retardant may be applied to the fibers at a subsequent stage of manufacturing, e.g., after blending with the binder fibers or forming the non-woven web, or after the non-woven web has been pleated. The treated fibers can be a carded and cross lapped nonwoven or can be vertically oriented as previously disclosed.

In one or more embodiments, the fire retardant bicomponent fibers with the optically active particles are blended with lyocell fibers, which can also be fire retardant treated. In one or more embodiments, ammonium polyphosphate can first be applied to the lyocell fibers and has been found to permeate substantially throughout a cross section of the lyocell fibers.

Exemplary fire retardants include, without limitation, chlorinated flame retardant compounds, such as chlorinated hydrocarbons, chlorinated phosphate esters, chlorinated polyphosphates, chlorinated organic phosphonates, chloroalkyl phosphates, polychlorinated biphenyls, polychlorinated dibenzo-p-dioxins and dibenzofurans are molecules containing a high concentration of chlorine that generally act chemically in the gas phase. They are often used in combination with antimony trioxide and/or zinc borate as a synergist. Three main families of chlorinated compounds include: (a) chlorinated paraffins; (b) chlorinated alkyl phosphates; and (c) chlorinated cycloaliphatic compounds.

Examples of chlorinated compounds include dodecachlorodimethanodibe-nzocyclooctane, tris(2-chloroethyl)phosphate, tris(2-chloro-1-methylethyl)phosphate, tris(2-chloro-1-(chloromethyl)ethyl)p-hosphate (TDPP), tris (chloropropyl)phosphate, tris (dichloropropyl)phosphat-e, tris(2-chloroethyl)phosphite, ammonium chloride, chlorendic acid, chlorendic anhydride, tris(dichlorobropropyl)phosphite, Bis(hexachlorocyclopentadieno)cyclo-octane, tris(dichloropropyl)phosphite, bis[bis(2-chloroethoxy)-phosphinyl]isop-ropylchloro-ethyl phosphate and MIREX® (1,1a,2,2,3,3a,4,5,5,5a,5b,6-dodecac-hloroocta-hydro-1,3,4-metheno-1H-cyclobuta(cd)pentalene).

Brominated fire retardant compounds, such as brominated organic compounds and brominated hydrocarbons, exhibit fire retardant efficiency in many materials. The three main families of brominated fire retardants include: (a) aliphatic brominated compounds; (b) aromatic brominated compounds; and (c) brominated epoxy fire retardants. Aliphatic brominated compounds include, for example, trisbromoneopentylphosphate, trisbromoneopentyl alcohol, dibromoneopentyl glycol, hexabromocyclohexane, hexabromocyclododecane, tetrabromo cyclopentane, hexabromo cyclohexane, hexabromo cyclooctane, hexabromo cyclodecane and hexabromo cyclododecane. Aromatic brominated compounds include, for example, hexabromo benzene, decabromobiphenyl, octabromodiphenyl oxide, hexabromobenzene, tris (tribromophenyl)triazine, tetrabromobisphenolA bis (2,3 dibromo propyl ether), dibromoneopentyl glycol, poly (pentabromobenzyl acrylate), pentabromodiphenyl ether, octabromodiphenyl oxide, octabromodiphenyl ether, decabromodiphenyl, decabromodiphenyl ethane, decabromodiphenyl oxide, decabromodiphenyl ether, tetrabromobisphenol A and brominated trimethylphenyl indan. Brominated epoxy fire retardants include brominated epoxy oligomers and polymers.

Other brominated fire retardant compounds include brominated diphenyl ethers, polybrominated diphenyl ethers, dimethyl-3-(hydroxymethy-lamino)-3-oxopropyl phosphonate, pentabromo toluene, tetrabromo chlorotoluene, pentabromo phenol, tribromo aniline, dibromobenzoic acid, pentabromotoluene, decabromodiphenyl oxide, tribromophenol, hexabromocyclododecane, brominated phosphorous, ammonium bromide, decabromobiphenyl oxide, pentabromobiphenyl oxide, decabromobiphenyl ether, 2,3-dibromopropanol, octabromobiphenyl ether, octabromodiphenyl oxide, tetrabromobiphenyl ether, hexabromocyclododecane, bis(tetrabromophthalimido) ethane, bis (tribromophenoxy)ethane, brominated polystyrene, brominated epoxy oligomer, polypentabromobenzyl acrylate, tetrabromobisphenol compounds, dibromopropylacrylate, dibromohexachlorocyclopentadienocyclooctane, N.sup.1-ethyl(bis)dibromonon-boranedicarboximide, decabromodiphenyloxide, decabromodiphenyl, hexabromocyclohexane, hexabromocyclododecane, tetrabromo bisphenol A, tetrabrombisphenol S, N'N'-ethylbis(dibromonon-bomene)dicarboximide, hexachlorocyclopentadieno-dibromocyclooctane, tetrabromodipenta-erythrito-1, pentabromoethylbenzene, decabromodiphenyl ether, tetrabromophthalic anhydride, hexabromobiphenyl, octabromobiphenyl, pentabromophenyl benzoate, bis-(2,3-dibromo-1-propyl)phthalate, tris (2,3-dibromopropyl) phosphate, N,N'-ethylene-bis-(tetrabromophthalimide), tetrabromophthalic acid diol[2-hydroxypropyl-oxy-2-2-hydroxyethylethyl-tetrabromophthalate]-, polybrominated biphenyls, tetrabromobisphenol A, tris(2,3-dibromopropyl)phosphate, tris(2-chloroethyl)phosphite, tris(dichlorobromopropyl) phosphite, diethyl phosphite, dicyandiamide pyrophosphate, triphenyl phosphite, ammonium dimethyl phosphate, bis(2,3-dibromopropyl)phosphate, vinylbromide, polypentabromobenzyl acrylate, decabromodiphenyl oxide, pentabromodiphenyl oxide, 2,3-dibromopropanol, octabromodiphenyl oxide, polybrominated dibenzo-p-dioxins, dibenzofurans and bromo-chlorinate paraffins.

Phosphorous-based fire retardants are compounds that include phosphorous, such as halogenated phosphates (chlorinated phosphates, brominated phosphates and the like), non-halogenated phosphates, triphenyl phosphates, phosphate esters, polyols, phosphonium derivatives, phosphonates, phosphoric acid esters and phosphate esters, which are the largest class of phosphorous flame retardant compounds. Phosphorous-based fire retardants are usually composed of a phosphate core to which is bonded alkyl (generally straight chain) or aryl (aromatic ring) groups. Halogenated phosphate compounds are often introduced to decrease total halogen concentration. Non-halogenated phosphate compounds include, for example, red phosphorous, inorganic phosphates, insoluble ammonium phosphate, ammonium polyphosphate, ammonium urea polyphosphate, ammonium orthophosphate, ammonium carbonate phosphate, ammonium urea phosphate, diammonium phosphate, ammonium melamine phosphate, diethylenediamine polyphosphate, dicyandiamide polyphosphate, polyphosphate, urea phosphate, melamine pyrophosphate, melamine orthophosphate, melamine salt of boron-polyphosphate, melamine salt of dimethyl methyl phosphonate, melamine salt of dimethyl hydrogen phosphite, ammonium salt of boronpolyphosphate, urea salt of dimethyl methyl phosphonate, organophosphates, phosphonates and phosphine oxide. Phosphate esters include, for example, trialkyl derivatives, such as triethyl phosphate and trioctyl phosphate, triaryl derivatives, such as triphenyl phosphate, and aryl-alkyl derivatives, such as 2-ethylhexyl-diphenyl phosphate.

Other examples of phosphorous-based fire retardants include methylamine boron-phosphate, cyanuramide phosphate, cresyl diphenyl phosphate, tris(1-chloro-2-propyl) phosphate, tris(2-chloroethyl)phosphate, tris(2,3-dibromopropyl)phosphate, triphenyl phosphate, magnesium phosphate, tricresyl phosphate, hexachlorocyclopentadiene, isopropyl triphenyl phosphate, tricresol phosphate, ethanolamine dimethyl phosphate, cyclic phosphonate ester, monoammonium phosphate and diammonium phosphate, which permit a char formation as a result of esterification of hydroxyl groups with the phosphoric acid, trialkyl phosphates and phosphonates, such as triethyl phosphate and dimethyl, aryl phosphates, such as triaryl phosphates, isopropyl triphenyl phosphate, octylphenyl phosphate, triphenylphosphate, ammonium phosphates, such as ammonium phosphate, ammonium polyphosphate and potassium ammonium phosphate, cyanuramide phosphate, aniline phosphate, trimethylphosphoramide, tris(1-aziridinyl)phosphine oxide, triethylphosphate, Bis(5,5-dimethyl-2-thiono-1,3,2-dioxaphosphorinamyl)oxide, Bis(2-chloroethyl)vinyl phosphate, dimethylphosphono-N-hydroxyme-thyl-3-propionamide, tris(chloropropyl)phosphate, tris(2-butoxyethyl) phosphate, tris (2-chloroethyl) phosphate, tris(2-ethylhexyl) phosphate, tris(chloropropyl)phosphate, tetrakis (hydroxymethyl)phosphonium salts, such as tetrakis (hydroxymethyl) phosphonium chloride and tetrakis (hydroxymethyl)phosphonium sulfate, n-hydroxymethyl-3-(dimethylphosphono-)-propionamide, urea phosphate, melamine pyrophosphate, a melamine salt of boron-polyphosphate, an ammonium salt of boron-polyphosphate, dicyandiamide pyrophosphate, triphenyl phosphite, ammonium dimethyl phosphate, fyroltex HP, melamine orthophosphate, ammonium urea phosphate, ammonium melamine phosphate, a urea salt of dimethyl methyl phosphonate, a melamine salt of dimethyl methyl phosphonate, a melamine salt of dimethyl hydrogen phosphite, polychlorinated biphenyls, a variety of alkyl diaryl phosphates and mixtures of monomeric chloroethyl phosphonates and high boiling phosphonates.

Metal hydroxide fire retardants include inorganic hydroxides, such as aluminum hydroxide, magnesium hydroxide, aluminum trihydroxide (ATH) and hydroxycarbonate.

Melamine-based fire retardants are a family of non-halogenated flame retardants that include three chemical groups: (a) melamine(2,4,6-triamino-1,3,5 triazine); (b) melamine derivatives (including salts with organic or inorganic acids, such as boric acid, cyanuric acid, phosphoric acid or pyro/poly-phosphoric acid); and (c) melamine homologues. Melamine derivatives include, for example, melamine cyanurate (a salt of melamine and cyanuric acid)), melamine-mono-phosphate (a salt of melamine and phosphoric acid), melamine pyrophosphate and melamine polyphosphate. Melamine homologues include melam (1,3,5-triazin-2,4,6-tri-amine-n-(4,6-diamino-1,3,5-triazine-2-yl), melem (2,5,8-triamino 1,3,4,6,7,9,9b-heptaazaphenalene) and melon (poly[8-amino-1,3,4,6,7,9,9b- -heptaazaphenalene-2,5-diyl). Other melamine-based fire retardant compounds are set forth hereinabove.

Borate fire retardant compounds include zinc borate, borax (sodium borate), ammonium borate, and calcium borate. Zinc borate is a boron-based fire retardant having the chemical composition xZnOyB2O3zH2O. Zinc borate can be used alone, or in conjunction with other chemical compounds, such as antimony oxide, alumina trihydrate, magnesium hydroxide or red phosphorous. It acts through zinc halide or zinc oxyhalide, which accelerate the decomposition of halogen sources and promote char formation.

Silicon-based materials include linear and branched chain-type silicone with (hydroxy or methoxy) or without (saturated hydrocarbons) functional reactive groups.

Phosphonic acid derivatives include phosphonic acid, ethylenediamine salt of phosphonic acid, tetrakis hydroxymethyl phosphonium chloride and n-methyl dimethylphosphono propionamide.

Examples of intumescent substances include, but are not limited to, ammonium polyphosphate, boric acid, chlorinated paraffin, DI-pentaerythritol, melamine, mono-ammonium phosphate, pentaerythritol, phosphate esters, polytetrafluoroethylene, tributoxyethyl phosphate, triethyl phosphate, tris (2-ethylhexyl) phosphonate, urea, xylene and zinc borate.

Examples of powdered metal containing flame retardant substances, which can be employed alone or in combination with other flame retardant substances, include, but are not limited to, magnesium oxide, magnesium chloride, talcum, alumina hydrate, zinc oxide, zinc borate, alumina trihydrate, alumina magnesium, calcium silicate, sodium silicate, zeolite, magnesium hydroxide, sodium carbonate, calcium carbonate, ammonium molybdate, iron oxide, copper oxide, zinc phosphate, zinc chloride, clay, sodium dihydrogen phosphate, tin, molybdenum and zinc.

Examples of fire retardant substances that can be applied to the synthetic bi-component polyester fibers with the optically active particles within the core also include boric acid, boron oxide, calcium borate, alumina trihydrate (alumina hydroxide), alumina carbonate, hydrated aluminum, aluminum hydroxide, antimony oxide, antimony trioxide, antimony pentoxide, sodium antimonate, magnesium carbonate, potassium fluorotitanate, potassium fluorozirconate, zinc oxide, hunite-hydromagnesite, ammonium octamolybdate, ammonium bromide, ammonium sulfate, ammonium carbonate, ammonium oxylate, barium metaborate, molybdenum trioxide, zinc hydroxystannate, sodium tungstate, sodium antimonate, sodium stannate, sodium aluminate, sodium silicate, sodium bisulfate, ammonium borate, ammonium iodide, tin compounds, molybdic oxide, sodium antimonate, ammonium sulfamate, ammonium silicate, quaternary ammonium hydroxide, aluminum tryhydroxide, tetrabromobisphenol A, titanium compounds, zirconium compounds, other zinc compounds, such as zinc stannate and zinc hydroxy-stannate, dioxins, diethyl phosphite, methylamine boron-phosphate, cyanoquanidine, thiourea, ethyl urea, dicyandiamide and halogen-free phosphonic acid derivatives. In one or more embodiments, the batting from the treated fibers may be formed using one of several processes for converting a source of fiber into a panel as is generally known in the art. The fire retardant treated bicomponent fibers with the optically active particles can be vertically oriented or carded and crosslapped. Carding and crosslapping processing of fibers in general to form panels thereof is well known in the art. Vertically oriented fibers of the synthetic bi-component fibers or blends therewith can be formed as described in U.S. Pat. No. 5,702,801, incorporated herein by reference in its entirety. In some embodiments, the peaks of the vertically oriented fibers in the batting material may be brushed or needle punched to improve the entwining of individual fibers of one peak into adjacent peaks. Adjacent peaks of vertically oriented fibers may be of substantially the same height, or alternatively may have different heights in a repeating pattern.

In one or more embodiments, the vertically oriented fibers can be in the form of pleats as discussed above. The pleats are formed from a cross laid non-woven web of fibers that can be less than 5 millimeters (mm) (i.e., about 0.2 inches)

thick before pleating and in other embodiments, about 2 mm thick (e.g., a mattress approximately 2000 mm long can have about 500 pleats, each or two sheets). As previously described above, in most embodiments, the fibers are 0.25 to 4 inches long. During manufacture, once pleated, the pleated layer can be cross-needled to provide additional structural strength.

The pleating can provide a pleated layer having a thickness less than about 2 inches. By means of a carding process when the fibers are laid, greater than 75%, and greater than 90% in other embodiments of the fibers of the non-woven web are aligned substantially vertically oriented relative to the plane defined by an underlying mattress or cushioning article, for example.

As noted above, the pleated layer can also include a binder fiber, which bonds the fibers to form a fiber mat. The binder fiber can be a bi-component fiber having a standard polyester core without the optically active particles, e.g., having a melting point of about 250° C. within a low melting temperature polyester surround having a melting point of about 130° C. During manufacture, the non-woven web can be heat treated above the melting temperature of the fiber surround but beneath the temperature of the fiber core to cause the bi-component fibers to bind the fire retardant treated fibers. After pleating, the non-woven web can be cross-needled to enhance its strength. Optionally, the pleated layer may be cut during the manufacturing process as a result of the vertically lapped arrangement of fibers.

Due to the vertical arrangement of the fibers in the pleated layer, when a load is applied to the cushioned article, e.g., mattress, a batting material or the like, the vertical arrangement of the fibers in the layer supports the load in a spring-like manner, compressing vertically to accommodate the shape of the load without flattening in the neighboring regions. In effect, the vertically oriented fibers, e.g., the vertically lapped formed pleats, act as vertical springs with cross needling to effect limited attachment between pleats but without causing pleats to flatten except under load. Moreover, when load is removed, the vertically oriented fibers readily recover it shape due to the independently spring-like nature of the vertically oriented fibers.

Advantageously, the vertically oriented fibers, e.g., vertically lapped formed pleats, have a low area density, which may result in lighter products and correspondingly less expensive to manufacture and transport.

Some exemplary embodiments of articles in which blends including the bicomponent fibers can be used include, but are not limited to, as one or more of the layers defining an innercore, a top layer overlying the innercore, mattress pads, mattress covers, mattress "toppers," the pillow-top portion of pillow-top mattresses, pillows, and the like. In other embodiments, the flame resistant fiber panels can be employed in mattresses as a batting material.

For a vertically oriented fiber batting material, the fibers in the blend generally have a length of 0.25 to 4 inches; in other examples, a length of 0.5 to 3 inches, and in still other examples, a length of 1.5 to 3 inches. By way of example, the cut lengths for carding are generally between 1.5 and 3 inches. The fiber batting material when vertically oriented can also have a total thickness or loft of 0.5 inches (1.25 centimeters) or greater. While there is no real limitation on how thick the batting can be, for many typical applications, the thickness of the high loft batting need not be higher than 3 inches (7.6 cm), and for many mattress applications less than 2 inches (5 cm) can be desirable. The flame resistant panels can also generally have a basis weight of about 5 to 18 ounces per square yard (169 to 610 grams per square meter) and, in one or more embodiments, is 8 to 11 ounces per square yard (271 to 373 grams per square meter). The total density of the batting material is generally aligned with the basis weights described above. Denser battings generally do not have the resiliency desired for use as cushioning in mattresses and other articles. As for battings that are less dense, the batting materials are oftentimes bulky to handle during fabrication and are generally compressed into the preferred density range when incorporated into a quilted composite. Thinner and denser battings also do not provide the desired softness, aesthetics, and may lack durability in application and with flame retardant protection.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mattress assembly comprising:

a fiber batting layer having a top planar surface and a bottom planar surface overlying a mattress core, the fiber batting layer comprises a plurality of fibers comprising a blend of fire retardant treated bicomponent fibers and untreated lyocell fibers, wherein the fire retardant treated bicomponent fibers consist of a polyethylene terephthalate core and a sheath about the core, and optically active particles embedded in the core, and a fire retardant material, wherein the optically active particles comprise one or more of aluminum oxide ($Al_2O_3$), quartz ($SIO_2$), and titanium dioxide ($TiO_2$) in rutile form, wherein the fire retardant treated bicomponent fibers and the lyocell fibers are vertically oriented relative to the underlying mattress core and have fiber lengths within a range of 0.25 and 4 inches, and wherein the fiber batting layer includes the fire retardant treated bicomponent fibers in an amount effective to meet a flammability standard set forth in 16 C.F.R. Part 1633.

2. The mattress assembly of claim 1, wherein the fire retardant material is selected from the group consisting of halogenated compounds, phosphorous containing compounds, sulfate containing compounds, metal hydroxides, borates, silicon based compounds, melamine based compounds, phosphonic acid derivatives, intumescent compounds, and mixtures thereof.

3. The mattress assembly of claim 1, wherein the batting material has a thickness greater than 0.5 inches to 3 inches.

* * * * *